US006307874B1

(12) United States Patent
Moller

(10) Patent No.: US 6,307,874 B1
(45) Date of Patent: Oct. 23, 2001

(54) EXPANSION LOOPS FOR HEATING ELEMENTS IN VACUUM FURNACES

(75) Inventor: Craig A. Moller, Roscoe, IL (US)

(73) Assignee: Ipsen International, Inc., Wilmington, DE (US)

( * ) Notice: Subject to any disclaimer, the term of this patent is extended or adjusted under 35 U.S.C. 154(b) by 0 days.

(21) Appl. No.: 09/648,249

(22) Filed: Aug. 25, 2000

(51) Int. Cl.[7] ..... H05B 3/00

(52) U.S. Cl. ..... 373/109; 373/117; 373/128; 219/552

(58) Field of Search ..... 373/109, 110, 373/112, 117, 118, 120, 128, 130, 131, 134; 219/538, 541, 548, 549, 552

(56) References Cited

U.S. PATENT DOCUMENTS 1,624,345 * 4/1927 Keene .
2,356,237 * 8/1944 Geller .
3,274,374 * 9/1966 Matheson et al. .
4,238,636 * 12/1980 Burstrom ..... 373/117
4,499,369 * 2/1985 Gibb ..... 219/552
5,497,394 * 3/1996 Jhawar et al. ..... 373/130
6,023,487 * 2/2000 Jones ..... 373/130

* cited by examiner

*Primary Examiner*—Tu Ba Hoang
(74) *Attorney, Agent, or Firm*—Dann, Dorfman, Herrell and Skillman, P.C.

(57) ABSTRACT

A heating element for a vacuum heat treating furnace, a hot zone for a vacuum heat treating furnace, and a vacuum furnace are disclosed. The heating element includes a first heating element portion formed of a thin form of conductive, refractory metal or alloy, and an expansion loop formed in or attached to the first heating element portion, to absorb expansive and contractive forces on the element due to thermal cycling. The heating elements are disposed around the interior surface of the hot zone, which includes a sidewall formed of thermally insulating material. The vacuum heat treating furnace includes a pressure vessel and a hot zone disposed within the pressure vessel.

3 Claims, 3 Drawing Sheets

EXPANSION LOOPS FOR HEATING ELEMENTS IN VACUUM FURNACES

FIELD OF THE INVENTION

This invention relates to electric furnaces for the heat treating of metals, and, in particular, to the current carrying heating element in such furnaces.

BACKGROUND OF THE INVENTION

Certain electric heat treating vacuum furnaces utilize heating elements, formed of bands or strips of molybdenum, as a source of radiant heat. These elements are typically supported by insulated hangers or standoffs, and may be arrayed in a substantially circular arrangement in the hot zone of the furnace, or in straight sections arranged transversely across the hot zone at the ends thereof. The molybdenum heating elements are connected in either a parallel or series circuit configuration to the electrical power terminals which penetrate the vacuum vessel.

As electrical current is introduced into, and subsequently removed from, the heating elements, they become heated to high temperatures and cooled from those temperatures, respectively. This heating and cooling of the element subjects it to high stresses from expansion and contraction. Such thermal cycling accelerates warping, bending, cracking, and overall distortion of the molybdenum heating elements and reduces their useful life. Furthermore, the potential for damage to the hot zone and contamination of the load in the furnace is increased if a heating element fails catastrophically.

In view of the foregoing problems, it would be highly advantageous to have a means of reducing the adverse effects of the stress on the heating elements that result from thermal cycling.

SUMMARY OF THE INVENTION

In accordance with a first aspect of the present invention there is provided a novel heating element for a vacuum heat treating furnace. The heating element according to the present invention includes a first heating element portion formed of a thin form of conductive, refractory metal or alloy and an expansion loop formed in or attached to the first heating element portion. The expansion loop is positioned and arranged to absorb expansion or contraction resulting from thermal cycling.

In accordance with another aspect of the present invention, there is provided a hot zone for a vacuum heat treating furnace. The hot zone, according to the present invention, includes a sidewall formed of thermally insulating material and having an interior surface. The hot zone also has a heating element disposed around the interior surface of said sidewall. The heating element has a first heating element portion formed of a thin form of a conductive, refractory metal or alloy, and an expansion loop formed in or attached to said first heating element portion. The expansion loop is positioned and arranged to absorb expansion or contraction resulting from thermal cycling.

In accordance with a further aspect of the present invention, there is provided a vacuum heat treating furnace. The vacuum furnace according to the present invention includes a pressure vessel and a hot zone disposed within the pressure vessel. The hot zone includes a sidewall formed of thermally insulating material and having an interior surface. A heating element is disposed around the interior surface of said sidewall. The heating element has a first heating element portion formed of a thin form of a conductive, refractory metal or alloy, and an expansion loop formed in or attached to said first heating element portion. The expansion loop is positioned and arranged to absorb expansion or contraction resulting from thermal cycling.

BRIEF DESCRIPTION OF THE DRAWINGS

The foregoing summary as well as the following detailed description of a preferred embodiment of the present invention will be better understood when read with the appended drawings, wherein.

DETAILED DESCRIPTION

Figure 1:
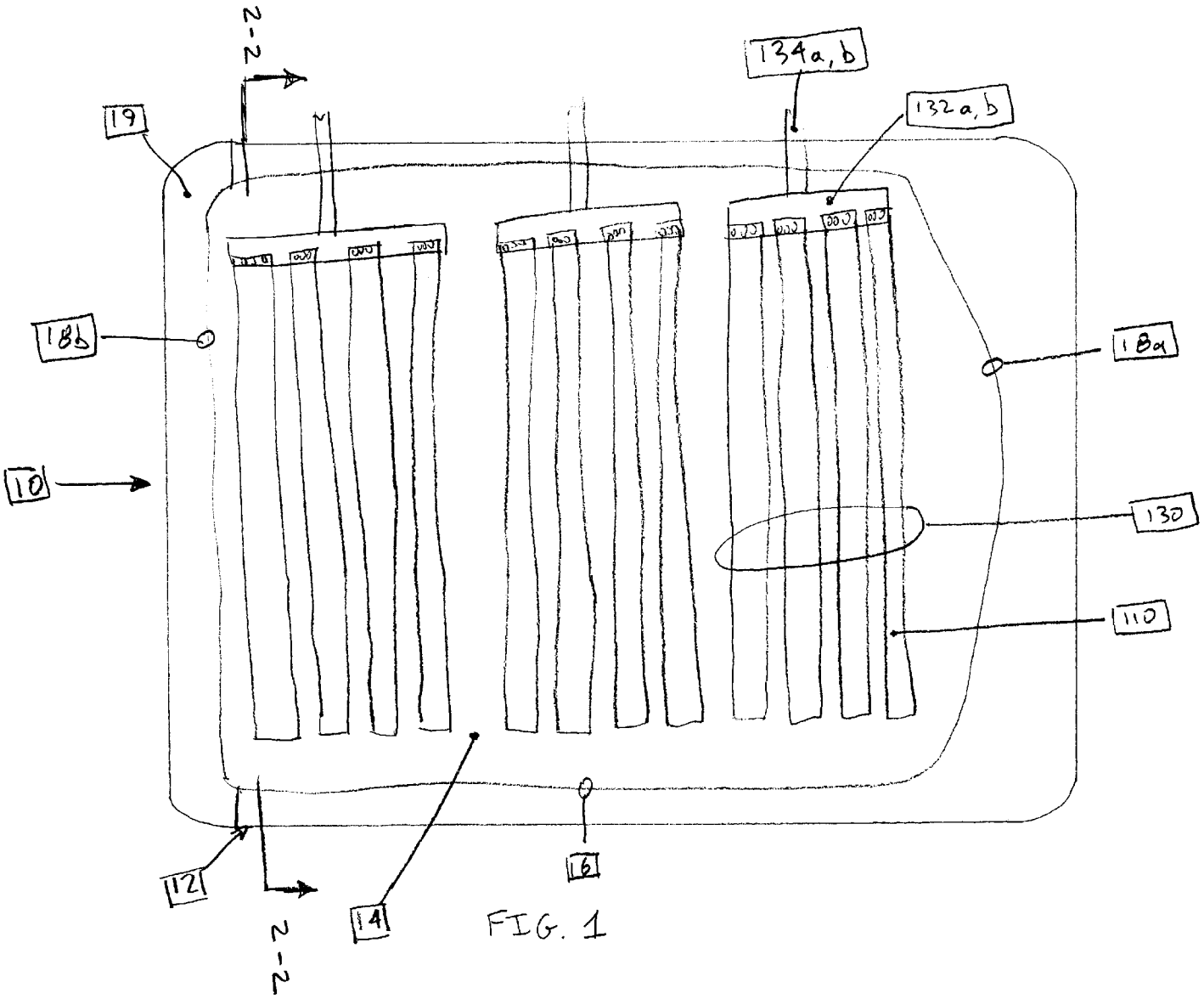
FIG. 1 is a side elevation view of the interior of a vacuum heat treating furnace.

Referring now to the drawings, wherein like reference numerals refer to the same components across the several views, and in particular to FIG. 1, there is shown a vacuum heat treating furnace 10. Vacuum furnace 10 includes a pressure vessel 12 and a hot zone 14. The hot zone 14 is defined by a insulating wall 16 that is substantially cylindrical in shape. The hot zone 14 is also defined by a first end wall 18*a* and a second end wall 18*b*. End wall 18*b* is typically mounted to the pressure vessel door 19 so that the interior of the hot zone 14 can be readily accessed when the pressure vessel door 19 is opened. Insulating wall 16 and endwalls 18*a* and 18*b* are formed of a thermally insulating material as known to those skilled in the art.

Figure 2:
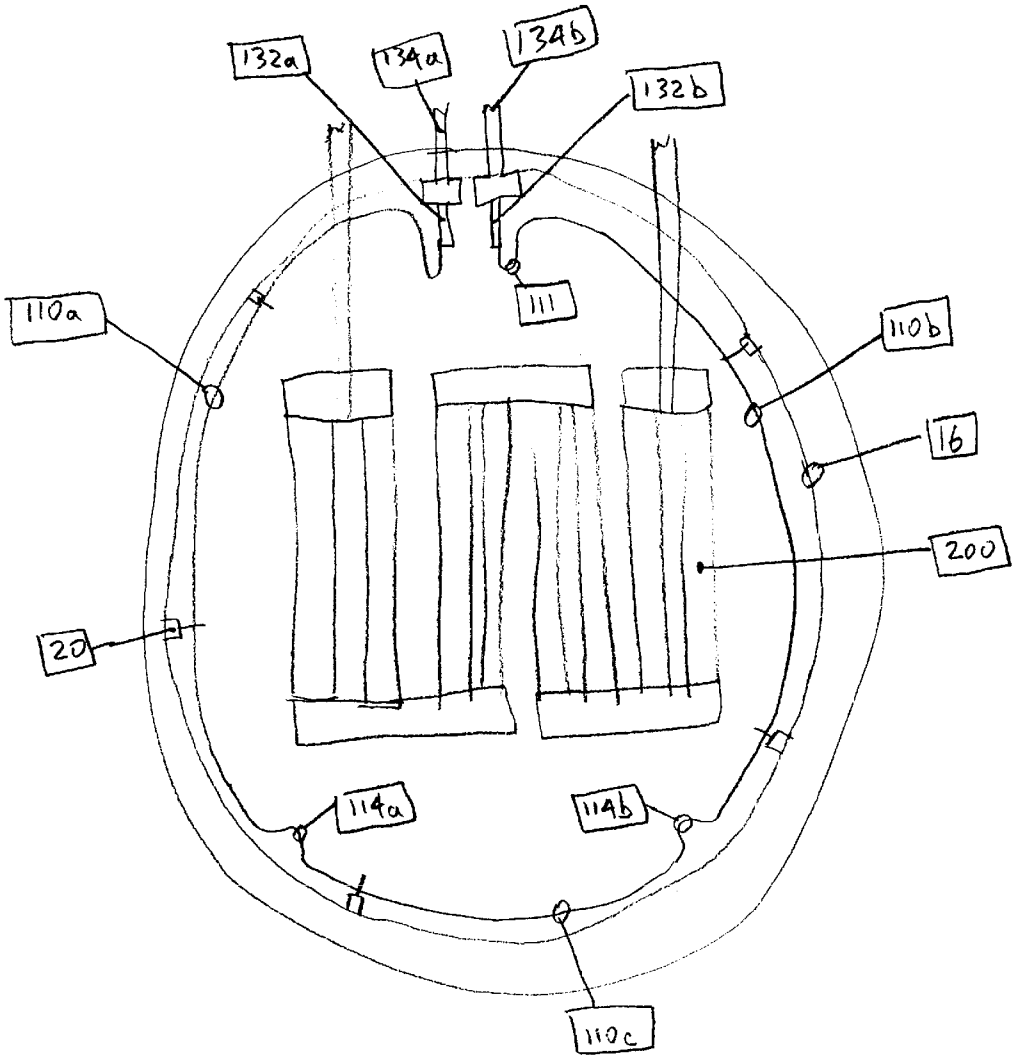
FIG. 2 is an end elevation view, in partial cross section, of the vacuum heat treating furnace of FIG. 1 as viewed along line 2—2 in FIG. 1.

Referring now to FIGS. 1 and 2, there are three circumferential heating element arrays in the hot zone 14 of vacuum furnace 10. Since the circumferential heating element arrays are essentially similar in structure, only one, heating element array 130 will be described. Power terminal buses 132*a* and 132*b* are connected to power feed through conductors 134*a* and 134*b*, respectively. The power terminal buses 132*a*, 132*b* are strips or bars, preferably formed of molybdenum, although another electrically conductive, refractory metal or alloy could be used. A heating element ring 110 is connected to the power bus terminals 132*a* and 132*b*. The heating element ring is formed of power terminal ring sections 110*a* and 110*b* and an intermediate ring section 110*c*, which interconnects the power terminal ring sections 110*a* and 110*b*. The other ends of the power terminal ring sections 110*a*, 110*b* are bolted to the power terminal buses 132*a* and 132*b*, respectively. In the embodiment shown in FIG. 1, there are three heating element arrays each having four heating element rings connected in parallel to the power terminal bus pair 132*a*, 132*b*. However, it will be appreciated by those skilled in the art that more or fewer heating element arrays each having more or fewer heating element rings and utilizing other connection schemes can be used depending on the design requirements for a particular vacuum furnace. The heating element rings 110 are supported from the hot zone wall 16 by a plurality of electrically insulating hangers or supports 20 arrayed at spaced intervals around the periphery of the interior of the hot zone wall 16. Each of the heating element ring sections includes a plurality of holes formed therein for receiving an attachment portions of the insulating supports.

Figure 3:
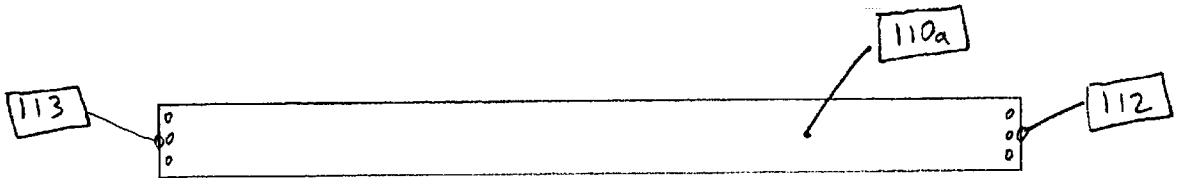
FIG. 3 is a plan view of a power terminal ring section electric heating element according to the present invention.
Figure 4:
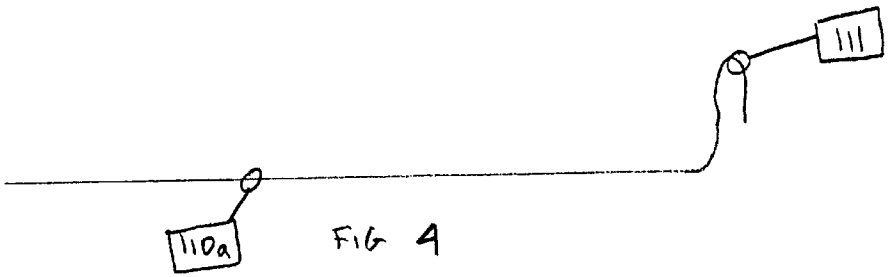
FIG. 4 is a side elevation view of the heating element shown in FIG. 3.
Figure 5:
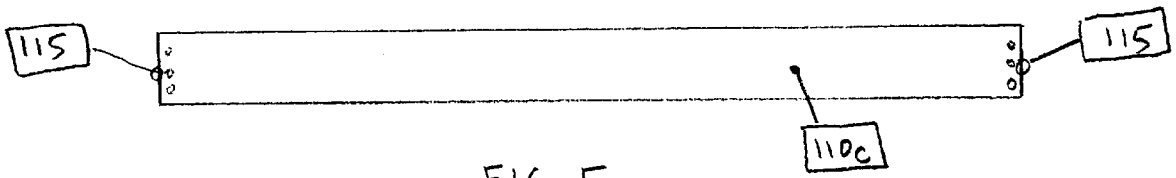
FIG. 5 is a plan view of an intermediate ring section electric heating element according to the present invention.
Figure 6:
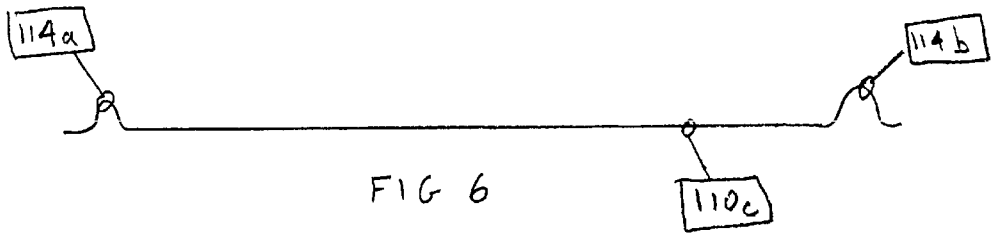
FIG. 6 is a side elevation view of the heating element shown in FIG. 5.
Figure 1:
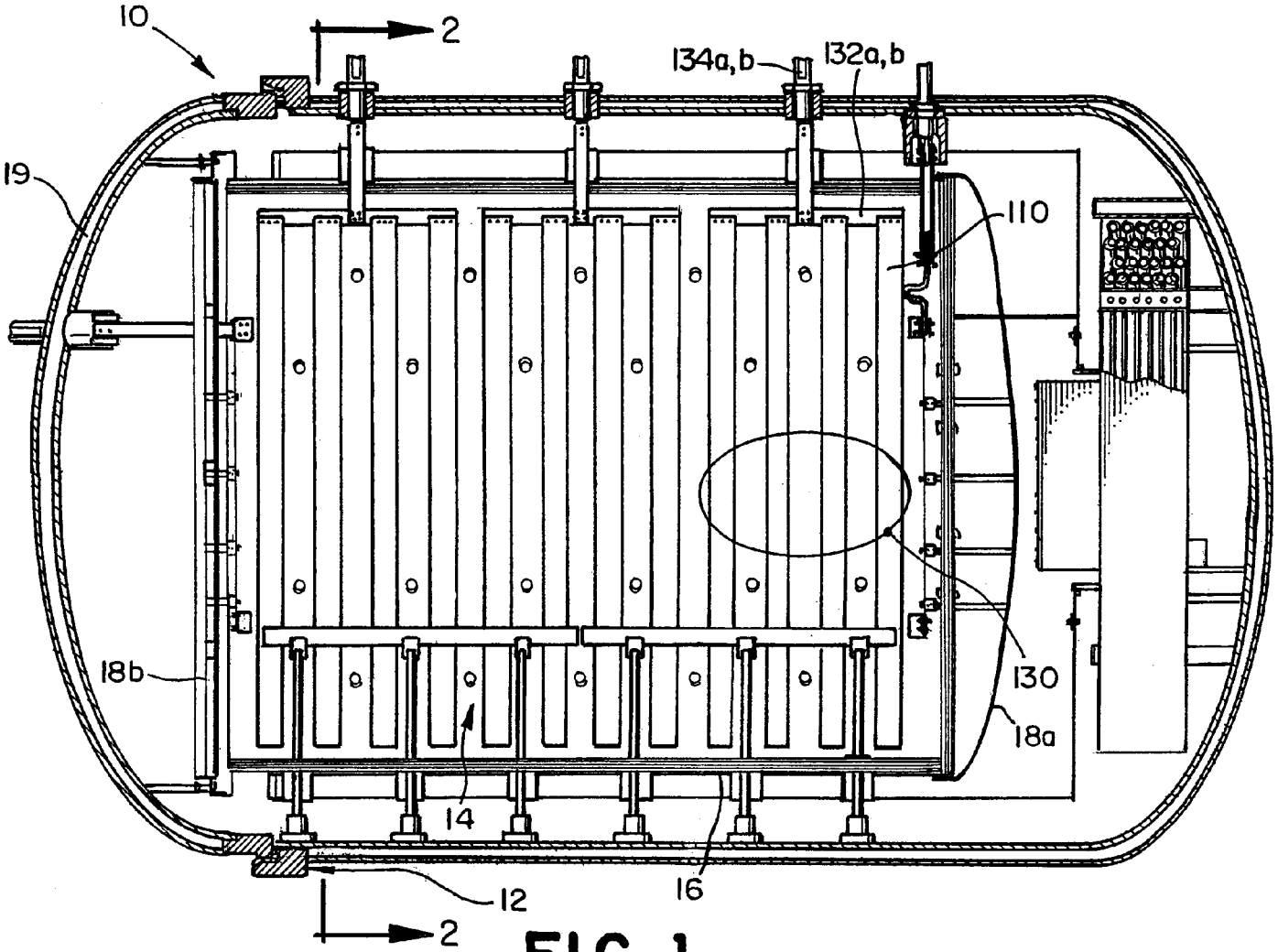
Figure 2:
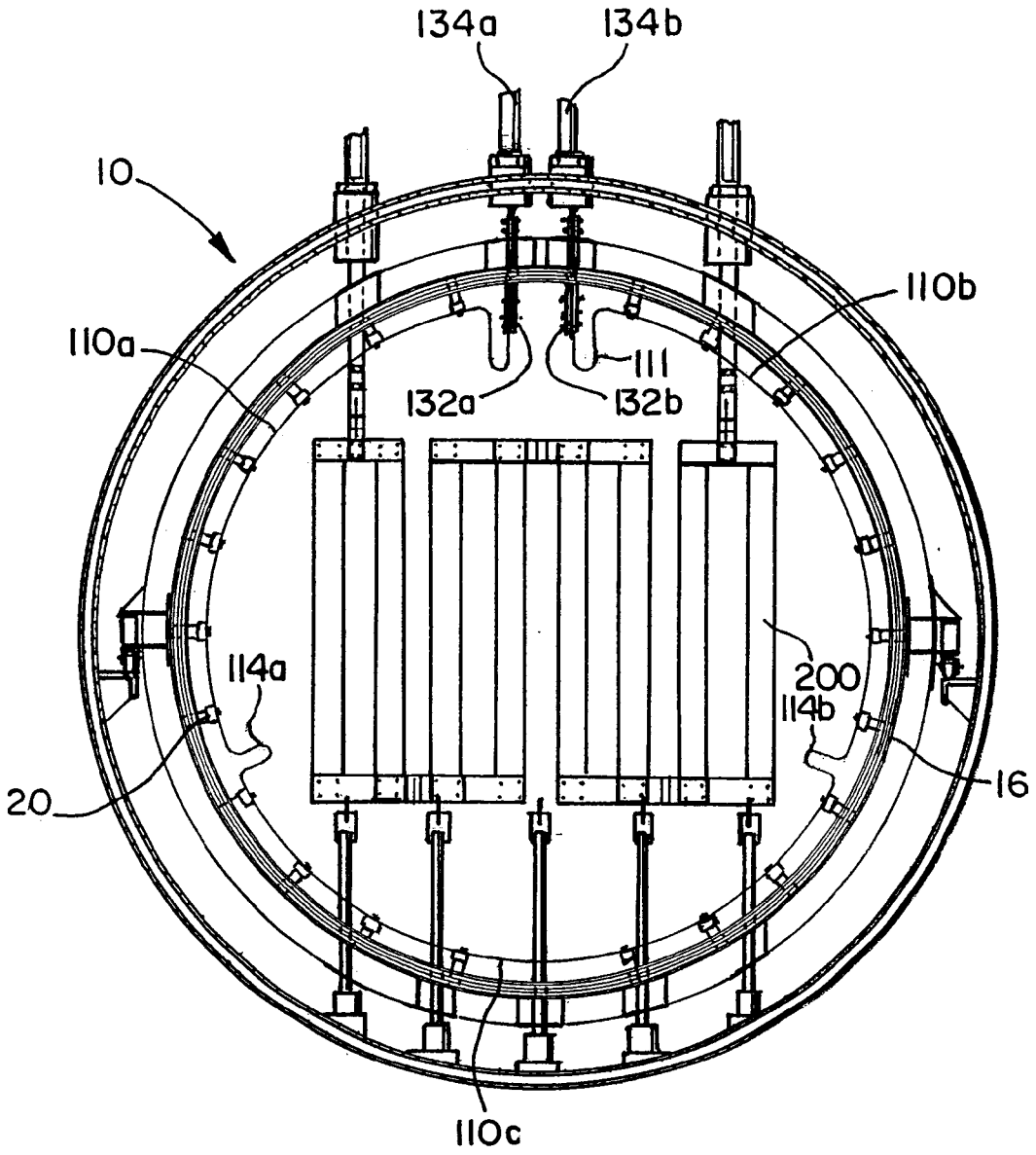
Figure 3:
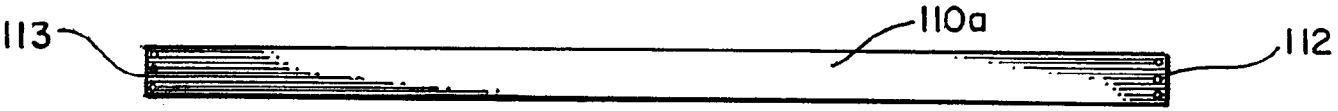
Figure 4:
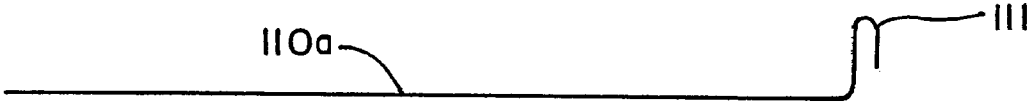
Figure 5:
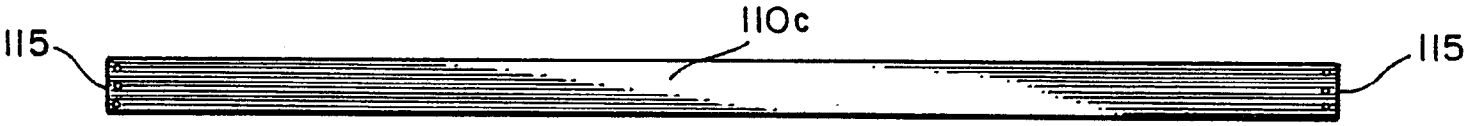
Figure 6:
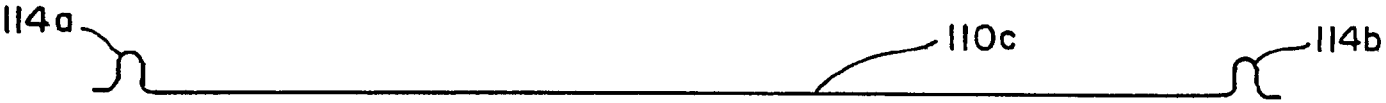
Figure 1:
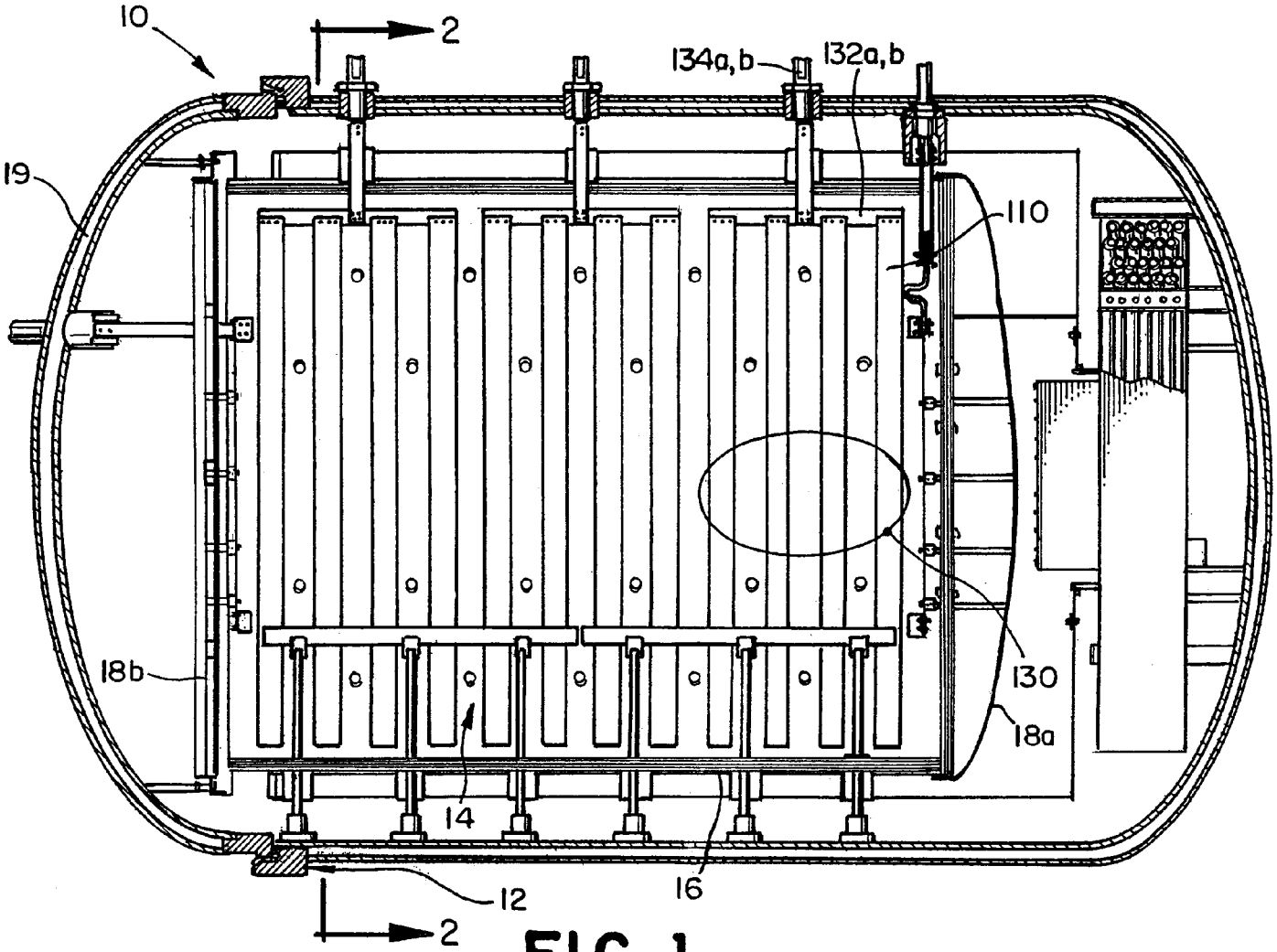
Figure 2:
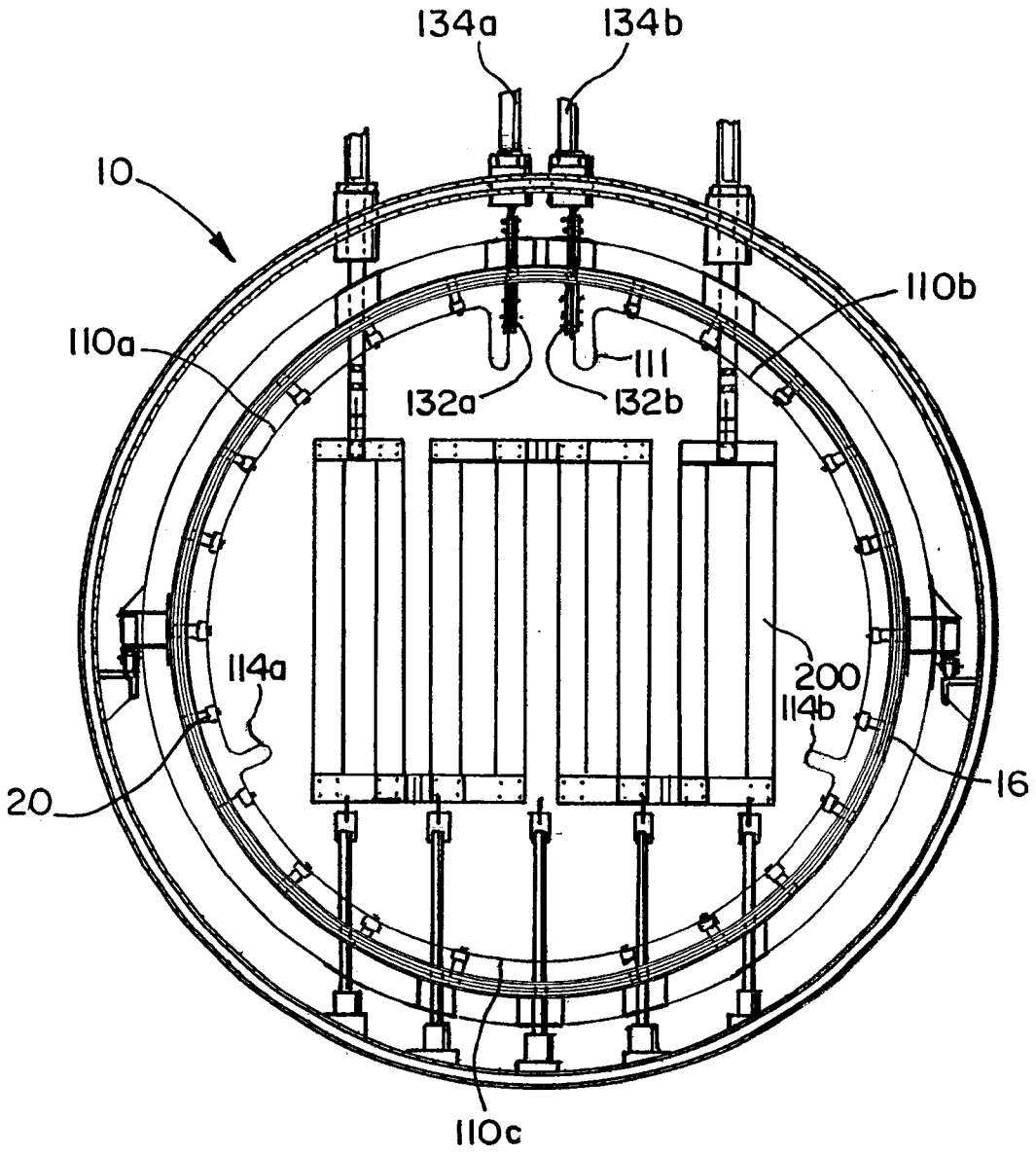
Figure 3:
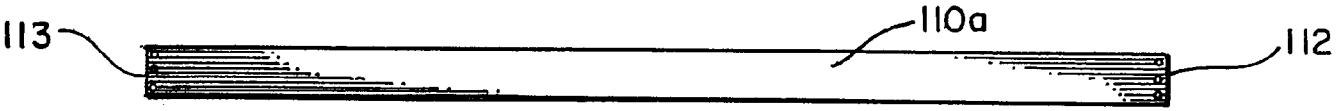
Figure 4:
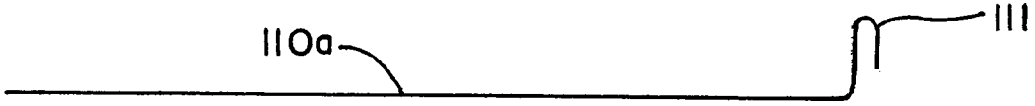
Figure 5:
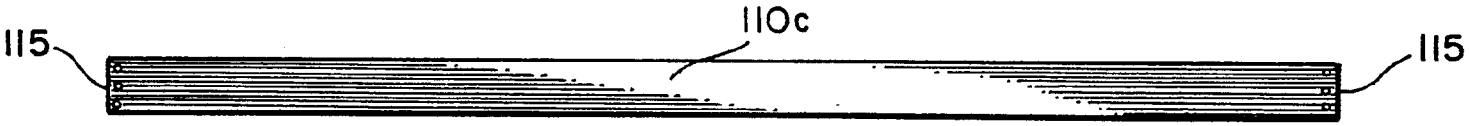
Figure 6:
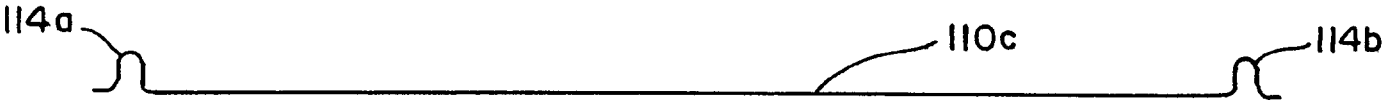

The structures of the power terminal ring sections 110*a* and 110*b* and of the intermediate ring section 110*c* will now be described with reference to FIGS. 3–6. As shown in FIGS. 3 and 4, the power terminal ring section 110*a*, which is typical of all the power terminal ring sections, is a strip, bar, or band of molybdenum or other electrically conductive metal or alloy. Power terminal ring section 110*a* has a power terminal end portion 112 and an inboard end portion 113. The power terminal end portion is adapted to be bolted or otherwise connected to the power terminal bus bar 132*a* and the inboard end portion is adapted to be bolted or otherwise connected to an end 115 of intermediate ring section 110*c*. An expansion loop 111 is formed in the molybdenum strip, bar, or band adjacent to the power terminal end portion 112 to provide a flexible portion to absorb expansion and contraction of the power terminal ring sections 110*a*, 110*b* during thermal cycling of the heating element ring 110. As shown in FIGS. 5 and 6, the intermediate ring section 110*c* has expansion loops 114*a* and 114*b* formed at both ends thereof for a similar purpose. The expansion loops 111, 114*a*, and 114*b* are preferably formed by bending the molybdenum strip, bar, or band with at an appropriate number of points. The bend radiuses are selected so as not to create sharp creases or crimps in the strip, bar, or band that will lead to cracking of the material. The profile of the expansion loops (radius and height) is selected to provide maximum flexibility and low stress on the heating elements. Those skilled in the art can readily select appropriate bending radiuses given the thickness and material of the strip, bar, or band from which the heating elements are formed. In the embodiments shown in FIGS. 3–6, the expansion loops are formed directly in the heating element strips. However, they can, alternately, be formed as separate elements if desired. Furthermore, the expansion loops can be formed as either single loops, or multiple layers of thin strips of material. It can also be seen by those skilled in the art that the described expansion loops can be incorporated into straight heating element sections 200, as are used on either end of the furnace, in addition to the ring heating elements.

In accordance with another feature of the present invention, the heating elements are provided with stiffening means to provide greater rigidity and strength to resist stresses induced during thermal cycling. In a preferred embodiment, the stiffening is accomplished by forming one or more longitudinally oriented ridges in the portions of the heating elements that do not have expansion loops formed therein. In the preferred embodiment, the ridges are formed by rolling them into the heating element material. Alternatively, stiffening ridges can be formed on the heating elements by affixing stiffening members such as strips or rods by welding or other affixation means known to those skilled in the art.

In view of the foregoing disclosure, some of the advantages of the of the present invention are apparent. For instance, a heating element for a vacuum heat treating furnace has been described which includes one or more expansion loops formed therein or connected thereto. The expansion loops provide a flexing portion that absorbs the expansion and contraction of the heating element material. In this way, stresses induced on the heating elements and hanger supports from the usual expansion and contraction resulting from thermal cycling are substantially reduced. As a result, the useful life of such heating elements can be significantly lengthened, thereby reducing furnace downtime and the cost of operating such furnaces. Furthermore, by reducing the damage to the element, itself, the invention protects the integrity of the load of metal parts being treated in the furnace, thus increasing the operating efficiency of the furnace.

What is claimed is:

1. A heating element for a vacuum heat treating furnace comprising:

a first heating element portion formed of a thin form of conductive, refractory metal or alloy, and an expansion loop formed in or attached to said first heating element portion, said expansion loop being positioned and arranged to absorb expansion or contraction of the first heating element portion during thermal cycling thereof.

2. A hot zone for a vacuum heat treating furnace comprising:

a sidewall formed of thermally insulating material, said sidewall having an interior surface;

a heating element disposed around the interior surface of said sidewall;

said heating element having a first heating element portion formed of a thin form of a conductive, refractory metal or alloy, and an expansion loop formed in or attached to said first heating element portion, said expansion loop being positioned and arranged to absorb expansion or contraction of the first heating element during thermal cycling thereof.

3. A vacuum heat treating furnace comprising:

a pressure vessel;

a hot zone disposed in said pressure vessel, said hot zone including a sidewall formed of thermally insulating material and having an interior surface; and a heating element disposed around the interior surface of said sidewall, said heating element having a first heating element portion formed of a thin form of a conductive, refractory metal or alloy, and an expansion loop formed in or attached to said first heating element portion, said expansion loop being positioned and arranged to absorb expansion or contraction of the first heating element portion during thermal cycling thereof.

* * * * *

UNITED STATES PATENT AND TRADEMARK OFFICE

CERTIFICATE OF CORRECTION

PATENT NO. : 6,307,874 B1
DATED : July 10, 2002
INVENTOR(S) : Craig A. Moller

It is certified that error appears in the above-identified patent and that said Letters Patent is hereby corrected as shown below:

Drawings,
Sheet 1 of 3, Figure 1, should be replaced with the attached Sheet 1 of 3, Figure 1.
Sheet 2 of 3, Figure 2, should be replaced with the attached Sheet 2 of 3, Figure 2.
Sheet 3 of 3, Figures 3-6, should be replaced with the attached Sheet 3 of 3, Figures 3-6.

Signed and Sealed this

Seventeenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,307,874 B1
DATED : July 10, 2002
INVENTOR(S) : Craig A. Moller

It is certified that error appears in the above-identified patent and that said Letters Patent is hereby corrected as shown below:

Drawings,
Sheet 1 of 3, Figure 1, should be replaced with the attached Sheet 1 of 3, Figure 1.
Sheet 2 of 3, Figure 2, should be replaced with the attached Sheet 2 of 3, Figure 2.
Sheet 3 of 3, Figures 3-6, should be replaced with the attached Sheet 3 of 3, Figures 3-6.

This certificate supersedes Certificate of Correction issued September 17, 2002.

Signed and Sealed this

Fifteenth Day of October, 2002

*Attest:*

*Attesting Officer*

JAMES E. ROGAN
*Director of the United States Patent and Trademark Office*